United States Patent [19]

Komuro

[11] Patent Number: 4,965,594

[45] Date of Patent: Oct. 23, 1990

[54] LIQUID JET RECORDING HEAD WITH LAMINATED HEAT RESISTIVE LAYERS ON A SUPPORT MEMBER

[75] Inventor: Hirokazu Komuro, Hiratsuka, Japan

[73] Assignee: Canon Kabushiki Kaisha, Tokyo, Japan

[21] Appl. No.: 230,703

[22] Filed: Aug. 5, 1988

Related U.S. Application Data

[63] Continuation of Ser. No. 19,125, Feb. 26, 1987, abandoned.

[30] Foreign Application Priority Data

Feb. 28, 1986 [JP] Japan ..... 61-44844
Nov. 7, 1986 [JP] Japan ..... 61-264006

[51] Int. Cl.[5] ..... B41J 2/05; B41J 2/205

[52] U.S. Cl. ..... 346/140 R; 338/320; 338/308

[58] Field of Search ..... 346/140, 76 PH; 219/543, 216 PH; 338/314, 320, 308, 309

[56] References Cited

U.S. PATENT DOCUMENTS

| | | | |
|---|---|---|---|
| 4,251,824 | 2/1981 | Hara et al. | 346/140 R |
| 4,330,787 | 5/1982 | Sato et al. | 346/140 R |
| 4,345,262 | 8/1982 | Shirato | 346/140 |
| 4,376,945 | 3/1983 | Hara | 346/140 |
| 4,450,457 | 5/1984 | Miyachi et al. | 346/140 R |
| 4,459,600 | 7/1984 | Sato et al. | 346/140 R |
| 4,536,250 | 8/1985 | Ikeda et al. | 156/651 |
| 4,567,493 | 1/1986 | Ikeda et al. | 346/140 R |
| 4,577,202 | 3/1986 | Hara | 346/140 R |
| 4,596,994 | 6/1986 | Matsuda et al. | 346/140 R |
| 4,613,844 | 9/1986 | Kent | 338/314 |
| 4,723,129 | 2/1988 | Endo | 346/140 X |

FOREIGN PATENT DOCUMENTS

| | | |
|---|---|---|
| 114977 | 7/1983 | Japan . |
| 31268 | 2/1986 | Japan . |

*Primary Examiner*—Joseph W. Hartary
*Attorney, Agent, or Firm*—Fitzpatrick, Cella, Harper & Scinto

[57] ABSTRACT

A liquid jet head having: a discharge port for discharing liquid; a liquid path communicating with the discharge port; and a plurality of electro-thermal converting elements for generating thermal energy used for discharging the liquid, wherein each of said electro-thermal converting elements has heat resistive layer and at least one pair of electrodes electrically connected to the heat resistive layer, and the heat resistive layers are laminated together with intermediate layers of insulator to form a laminate in a direction perpendicular to a direction at which the liquid is supplied to a heat acting surface of the electro-thermal converting elements.

24 Claims, 3 Drawing Sheets

LIQUID JET RECORDING HEAD WITH LAMINATED HEAT RESISTIVE LAYERS ON A SUPPORT MEMBER

This application is a continuation of application Ser. No. 019,125 filed Feb. 26, 1987, now abandoned.

BACKGROUND OF THE INVENTION

1. Field of the Invention

The present invention relates to a liquid jet recording head and more particularly it relates to a liquid jet recording head which discharges a recording liquid as liquid droplets and which can make a gradation record.

2. Related Background Art

Hitherto, non-impact recording methods have attracted attention because they produce little noise. Especially, the liquid jet recording method (ink-jet recording method) is a very useful method which makes a high-speed recording possible and which, besides, makes it possible to record on normal paper without the special treatment of fixation. Thus, many proposals have been made for various systems using such method and apparatuses for practicing them and some of them have been further improved and commercialized. Until now, efforts have been made for practical use of these methods.

Above all, those which are disclosed in Japanese Patent Application Laid-Open No. 51837/1979 and West German Laid-Open Application (DOLS) No. 2843064 have characteristics different from other ink-jet recording systems in that heat energy is allowed to act on a liquid to obtain power to discharge a recording liquid as liquid droplets.

That is, according to the recording systems disclosed in the above publications, the liquid which has undergone the action of heat energy changes in its state with an abrupt increase in volume, which includes generation of bubbles, and action based on said change in state permits the recording liquid to be discharged as droplets from orifices of the tip portion of the recording head and these droplets adhere to a recording member to make a record.

Furthermore, the ink-jet recording system disclosed in DOLS 2843064 has the advantage that images of high resolution and high quality can be obtained at high speed because the recording head part can easily be formed as a high density multi-orifice device of full-line type.

While, as explained above, liquid jet recording apparatuses have many advantages, in order to record images of higher resolution and higher quality, it has been required to give gradation to the picture elements to record images containing halftime information.

Hitherto, as systems for providing such liquid jet recording apparatus with gradation controllability, there have been known a first system, (1) according to which one picture element is composed of plural cells arranged in a matrix form and gradation of the desired level is digitally expressed depending on the number of cells and state of arrangement of these cells which are occupied by image forming elements realized in the cells arranged in matrix form, and a second system (2) according to which one picture element is formed of respective image forming elements and the desired gradation is analoguely expressed by changing optical density of the image forming elements.

However, in the case of the liquid jet recording methods which records by discharging liquid by heat energy, according to the above (1) gradation control system (the first system), the area of one picture element per se increases, which results in a reduction of resolution, etc. Furthermore, because of digital control, steps of gradation are large and sometimes the image obtained lacks fineness in texture. On the other hand, according to the above gradation control system (2) (the second system), in general, the size of one picture element, namely, the size of the image forming element, may be changed by changing electrical energy applied to an energy generator and in this case, sometimes, sufficient gradation control cannot be obtained.

Therefore, as disclosed, for example, in Japanese Patent Application Laid-Open No. 132259/1980, there has been proposed a recording head wherein plural heater elements are arranged in line with the discharge direction in the nozzle and the number of operating heater elements is controlled to change the size of the heat acting area, whereby modulation of volume of bubbles is effected by variation of area in which the bubbles are generated.

Moreover, according to the recording head disclosed in U.S. Pat. No. 4,251,824, at least two heating elements different in area of heater are arranged in the discharging direction in a nozzle and one suitable heater is selected in accordance with input signal to make dot diameter changeable, thereby to control gradation.

That is, in the case of the above-mentioned recording heads, plural heating elements are arranged in along the liquid supply direction in a nozzle and the heat acting area is changed by selection of these heater elements or operation of plural heating elements in combination, whereby dot diameter is changed to control gradation.

However, when plural heating elements are arranged in the liquid supply direction in the nozzle as mentioned above, the relative distance between said heating elements and discharge opening of nozzle is varied.

Especially when the entering direction of ink into the heat acting part and the discharging direction of the ink from the heat acting part are different as disclosed in U.S. Pat. No. 4,330,787 and 4,459,600, that is, when the discharge openings are provided at a face opposite to the heat acting face, and when relative positional relation between the center of bubble generation, namely, the center of the heat acting part, and the discharge opening changes as a result of using the abovestated construction, sometimes, there occurs deviation in the discharge direction of the ink. Furthermore, in some cases, such recording head is not suitable for highspeed recording due to change of discharging characteristics. Especially when the number of the heating elements increases, the above-mentioned tendency becomes conspicuous and so hitherto, area or the number of the heating elements has been subject to those limitations.

SUMMARY OF THE INVENTION

The object of the present invention is to provide a liquid jet recording head which is free from the above-mentioned problems and which makes it possible to make gradation recording with constantly stable performance.

The above object has been accomplished according to the present invention by a liquid jet recording head which has discharge ports for discharging a recording liquid, a liquid passage communication with the discharge ports and plural electricity-heat transducers provided with a heating resistive layer and a pair of electrodes electrically connected to said heat resistive layer, wherein the plural electro-thermal converting members, are laminated and the discharge openings are provided right above the heat acting face of the respective laminated electro-thermal converting members.

DETAILED DESCRIPTION OF THE PREFERRED EMBODIMENTS

Figure 1:
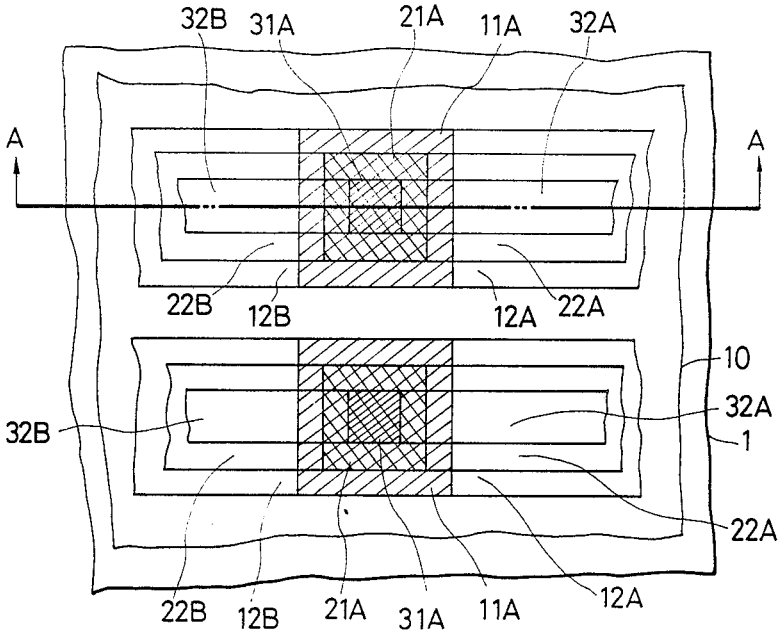
FIG. 1 is a schematic plan view of one construction example of an electricity-heat transducer on a substrate according to the liquid jet recording head of the present invention.

Referring to the drawings, the preferred embodiments according to the present invention will be illustrated below.

Figure 2:
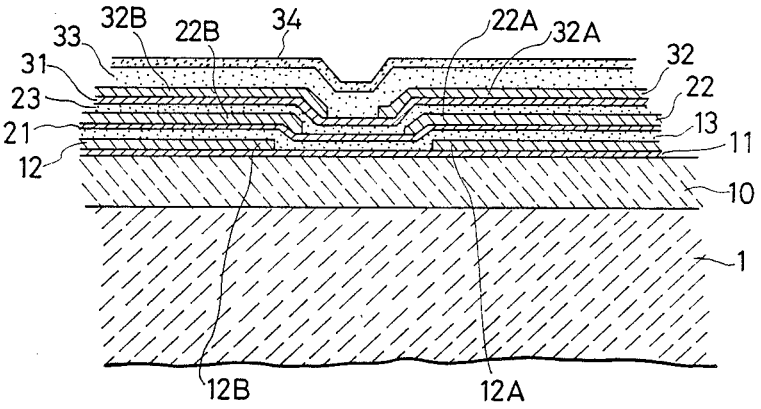
FIG. 2 is a cross-sectional view along the line A—A in FIG. 1.
Figure 3:
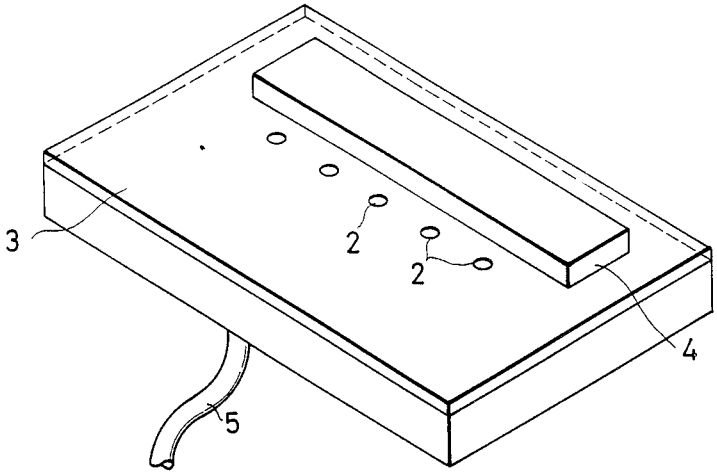
FIG. 3 is an oblique view of the liquid jet recording head of the present invention.

FIGS. 1–3 show one embodiment of the present invention. Reference number 1 indicates a wafer obtained, for example, from a single crystal ingot of silicon Si, and on Si wafer 1 is formed a silica ($SiO_2$) layer 10, as a lower layer, of about 3 μm thick by thermal oxidation. On layer 10 is formed a first heating resistor layer 11 of hafnium boride $HfB_2$ having a thickness of about 0.2 μm, for example, by a sputtering method using a magnetron. On this layer 11 is further formed first electrode layer 12 of aluminum Al having a thickness of about 0.2 μm by vacuum deposition and thereafter, first electrodes 12A and 12B and first heater 11A having a heating area of about 100 μm×100 μm are formed in the form of a pattern by photolithography. The wafer may be made of glass, ceramics or plastics. In the present embodiment, a support is composed of a Si wafer and silica layer.

Then, thereover is deposited silica ($SiO_2$) at a thickness of about 0.2 μm, for example, by a bias sputtering method. In this embodiment, it is important that when the thus formed silica ($SiO_2$) insulating layer becomes too irregular at the edge portions of heaters formed thereafter in the form of a laminate, bubbling from the heating surface becomes unstable. Therefore, in this example, it is attempted to keep the insulating layer formed between upper and lower heaters as smooth as possible. Reference number 13 indicates a first insulating layer formed according to this idea.

After the first electrodes 12A and 12B and the first heater 11A have been thus covered with insulating layer 13, the similar procedures are repeated to provide, in the form of a pattern, second electrodes 22A and 22B of aluminum at a thickness of about 0.2 μm and a second heater 21 of $HfB_2$ having an area of about 75 μm×75 μm and a thickness of about 0.2 μm and then to cover these electrodes and heater with second insulating layer 23 of silica ($SiO_2$) having a thickness of about 0.2 μm.

Successively, there are formed third electrodes 32A and 32B of aluminum and third heater 31 of $HfB_2$ having a thickness of about 0.2 μm and an area of about 50 μm×50 μm and then formed thereon a first protective layer 33 of silica ($SiO_2$) having a thickness of about 0.6 μm by a bias sputtering method. Reference number 34 indicates a second protective layer, which is formed, for example, of tantalum Ta at a thickness of about 0.3 μm by a sputtering method using a magnetron. In FIG. 2, reference numbers 21 and 31 indicate second the heat resistive layer and third heat resistive layer, respectively, reference numbers 22 and 32 indicate the second electrode layer and third electrode layer, respectively, and reference number 34 indicates the second protective layer.

On the thus constructed substrate is provided orifice plate 3 having orifices 2 perforated therethrough and is further formed liquid chamber 4 and liquid supply system 5 is fitted to the substrate as shown in FIG. 3 to obtain a liquid jet recording head.

A pulse signal is applied selectively or simultaneously to first electrodes 12A and 12B, second electrodes 22A and 22B and third electrodes 32A and 32B of the recording head, thereby to obtain records with droplets of such diameters as shown in Table 1, respectively.

Figure 4:
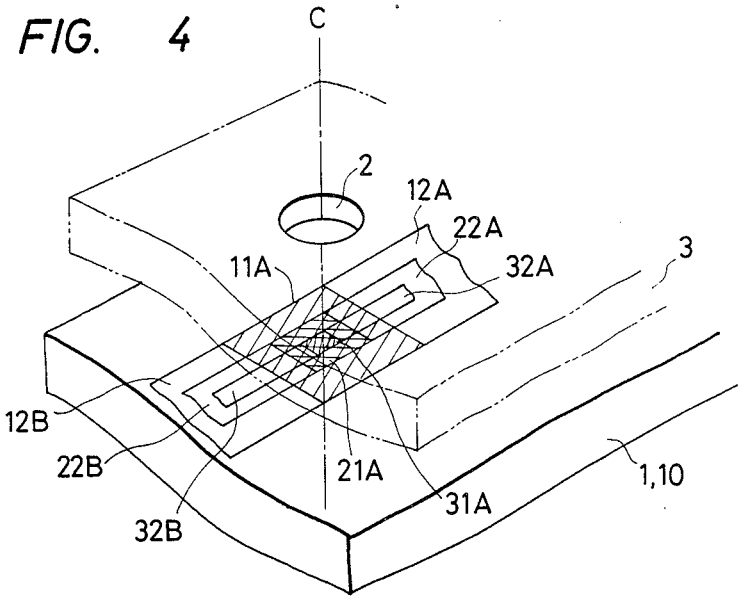
FIG. 4 is an oblique partial view of the recording head of FIG. 3 shown in perspective.

As is clear from Table 1, the discharge characteristics are closely proportioned to the effective area of the heater without bringing about great changes in discharge speed or frequency characteristics. It is a matter of course that such result is attributable to the fact that as shown in FIG. 4, orifice 2 is positioned just above the center line of the laminated heaters (C shows the center line) and thus the relative position between orifice 2 and respective heaters 11A, 21A and 31A is kept a constant value.

Further, the above fact also can be realized in the case that the distances between an orifice and each of heaters are kept to be constant.

TABLE 1

| Electrode | Diameter of liquid droplets |
|---|---|
| The first heater | 100 μm |
| The second heater | 56 μm |
| The third heater | 25 μm |

The above explanation refers to the example of use of three heaters in the form of a laminate, but the number of heaters is not limited thereto and the number may be optionally increased or decreased.

Furthermore, the sizes of the heaters are also not limited to those of the above example and may optionally be chosen and moreover, one of them may be chosen or plural heaters may be simultaneously used in combination.

Further, although in the above embodiment, the rates of resistance per unit area of the laminated heat resistive layers are the same, that is the laminated heat resistive layers are made of the same material, or instead, different materials may be used for the respective the laminated resistive layers.

Further, although in the above explained embodiments, the discharge ports are arranged just above the heat acting surface of the laminated electro-thermal converting member, the present invention is not limited to only the above cases.

For example, the discharge ports may be arranged so that the discharge direction of the liquid for recording from the discharge ports is the same as the liquid supply direction to the heat acting surface.

Figure 5:
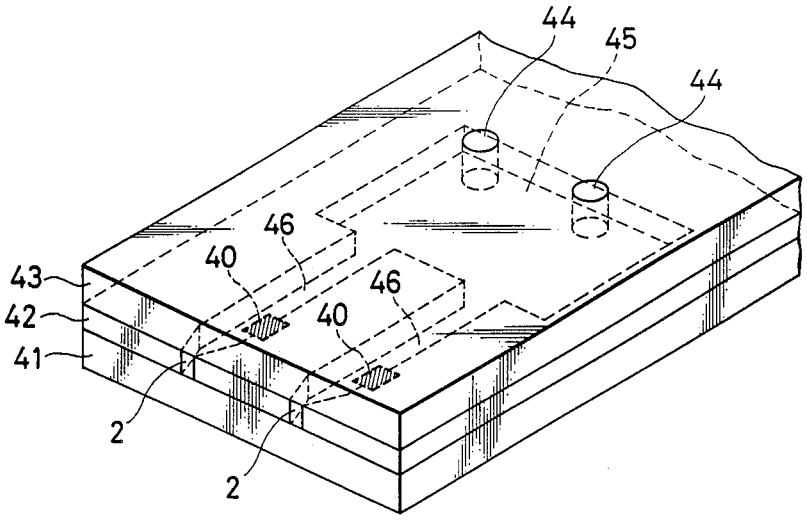
FIG. 5 is an oblique view of the recording head according to an another embodiment of the present invention.

FIG. 5 shows such an ink jet recording head, show there is. FIG. 5 is an oblique view, embodiment.

In FIG. 5, liquid path wall forming layer 42 is formed on an electro-thermal converting member bearing substrate 41 by photo-sensitive material, etc., and a top plate is adhered thereon. The liquid for recording is supplied from an opening 44, a liquid chamber 45 and a liquid flow path 46 to be discharged from a discharge port 2. A good graduated recording can be also realized by the use of an ink jet head shown in FIG. 5.

According to the liquid jet recording head of the present invention, since plural electricity-heat transducers are provided in the form of a laminate on a substrate, the relative position between discharge orifices and respective electricity-heat transducers can be kept constant in both the distance and the direction, since physical conditions at discharging of liquid droplets do not change even if heating area or quantity of heat is changed due to selection or combination of these electricity-heat transducers, a record having gradation can be made while maintaining a stable discharging performance, and furthermore, the plural electricity-heat transducers can be readily contained in one nozzle without their occupying of a large space. As a result, it also becomes possible to make a liquid path in a multi orifice type of high density.

As described hereabove, according to the present invention, by laminating plural electricity-heat transducers together with intervening insulating layers on a substrate of a liquid path, the relative position between nozzle orifices and the electricity-heat transducers is kept constant, and thus it becomes possible to maintain discharge performance at stable state and to accomplish superior gradation recording.

The material of the first and second insulating layer may include, in addition to the materials described above, thin-film materials such as transition metal oxides, such as, titanium oxide, vanadium oxide, niobium oxide, molybdenum oxide, tantalum oxide, tungsten oxide, chromium oxide, zirconium oxide, hafnium oxide, lanthanum oxide, yttrium oxide, manganese oxide and the like; other metal oxides, such as aluminum oxide, calcium oxide, strontium oxide, barium oxide, silicon oxide and the like; and complexes of the above metals; high dielectric nitrides, such as silicon nitride, aluminum nitride, boron nitride, tantalum nitride and the like; complex of the above oxides and nitrides; semiconductive materials such as amorphous silicon, amorphous selenium and the like, which are of low resistance in a bulk state but are rendered highly resistive in a manufacturing process such as the sputtering process, CVD process, vapor deposition process, vapor phase reaction process or liquid coating process. The film thickness is usually 0.1–5 μm, preferably 0.2–3 μm and more preferably 0.5–3 μm. Further organic materials for the above purpose include resins, for example, silicon resin, fluorine-contained resin, aromatic polyamide, addition polymeric polyimide, polybenzimidazole, polymer of metal chelate, titanate ester, epoxy resin, phthalic resin, thermosetting phenolic resin, p-vinyl phenol resin, Zirox resin, triadine resin, BT resin (addition polymerized resin of triazine resin and bismaleimide) and the like. Alternatively, the protection layer may be formed by vapor-depositing polyxylene resin or a derivative thereof.

Alternatively, the second upper protection layer 209 may be formed by plasma polymerizing method from various organic compound monomers such as, thiourea, thioacetamide, vinylferrocene, 1,3,5-trichlorobenzene, chlorobenzene, styrene, ferrocene pyrroline, naphthalene, pentamethylbenzene, nitrotoluene, acrylonitrile, diphenylselenide, p-toluidine, p-xylene, N,N-dimethyl-p-toluidine, toluene, aniline, diphenylmercury, hexamethylbenzene, malonitrile, tetracyanoethylene, thiophene, benzeneselenol, tetrafluoroethylene, ethylene, N-nitrosodiphenylamine, acetylene, 1,2,4-trichlorobenzene, propane and the like.

In manufacturing a high density multi-orifice-type recording head, the protection layer may be preferably formed by an organic material which is readily processed by fine photolithography. More preferably examples of such material include, for example, polyimidoisoindoloquinazoline dione (trade name: PIQ available from Hitachi Kasei, Japan), polyimide resin (trade name: PYRALIN available from DuPont); cyclic polybutadiene (trade name: JSR-CBR available from Japan Synthetic Rubber, Japan); photosensitive polyimido resins such as Photoneece (available from Toray, Japan), photoreactive polyamic acid for lithography (trade name: PAL available from Hitachi Kasei, Japan) and the like.

Polyimidoisoindoloquinazoline dione
(trade name: PIQ, available from Hitachi Kasei Co., Japan)

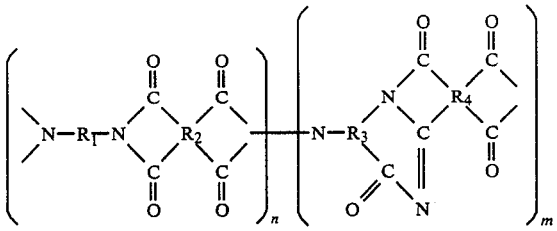

Polyimide resin (trade name: PYRALIN, available from Du Pont, U.S.A.)

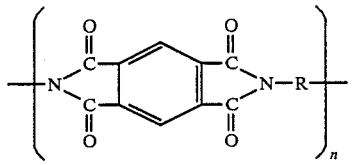

Cyclized polybutadiene (trade name: JSR-CBR, available from Japan Synthetic Rubber Co., Japan)
(Heat resistive Photoresist)

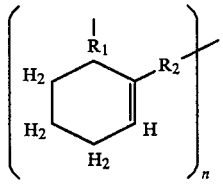

The material of the protection layer further may include an element of the group IIIa of the periodic table such as Sc or Y, an element of the group IVa such as Ti, Tr or Hf, an element of the group Va such as V or Nb, an element of the group VIa such as Cr, Mo or W, an element of the group VIII such as Fe, Co or Ni, an alloy of the above metals such as Ti-Ni, Ta-W, Ta-Mo-Ni, Ni-Cr, Fe-Cr, Ti-W, Fe-Ti, Fe-Ni, Fe-Cr, Fe-Ni-Cr, a boride of the above metals such as Ti-B, Ta-B, Hf-B or W-B, a carbide of the above metals such as Ti-C, Zr-C, V-C, Ta-C, Mo-C or NiC, and a silicide of the above metals such as Mo-Si, W-Si or Ta-Si, and a nitride of the above metals such as Ti-N, Nb-N or Ta-N. The layer may be formed by vapor deposition process, sputtering process, CVD process or other process and the film thickness thereof is usually 0.01–5 μm, preferably 0.1–5 μm and more preferably 0.2–3 μm. The material and the film thickness are preferably selected such that a specific resistivity of the layer is larger than specific resistivities of the ink, the heat generating resistive layer and electrode layer. For example, it has a specific resistivity of 1Ω-cm or less. An insulative material such as Si-C having a high anti-mechanical shock property is preferably used.

The underlying layer principally functions as a layer to control conduction of the heat generated by the heat generating portion to the support. The material and the film thickness of the underlying layer are selected such that the heat generated by the heat generating portion is more conducted to the heat applying portion when the thermal energy is to be applied to the liquid in the heat applying portion, and the heat remaining in the heat generating portion is more rapidly conducted to the support when the heat conduction to the heating portion 202 is blocked. The material of the underlying layer 206 includes, in addition to $SiO_2$ described above, inorganic materials as represented by metal oxides such as zirconium oxide, tantalum oxide, magnesium oxide and aluminum oxide.

The material of the heat generating resistive layer may be any material which generates heat when energized.

Preferably examples of such materials are tantalum nitride, nickel-chromium alloy, silver-palladium alloy, silicon semiconductor, or metals, such as hafnium, lanthanum, zirconium, titanium, tantalum, tungsten, molybdenum, niobium, chromium, vanadium, etc., and alloys and borides thereof.

Of the materials of the heat generating resistive layer, the metal borides are particularly suitable, and of those, preference may be placed on hafnium boride for its most excellent property, and there follow zirconium boride, lanthanum boride, tantalum boride, vanadium boride and niobium boride in the order as mentioned.

The heat generating resistive layer can be formed of those materials by an electron beam vapor deposition process or a sputtering process.

The film thickness of the heat generating resistive layer is determined in accordance with an area and material thereof and a shape and a size of the heat applying portion and power consumption so that a desired amount of heat per hour may be generated. Usually, it is 0.001–5 μm and preferably 0.01–1 μm.

The material of the electrode may be any conventional electrode material such as Al, Ag, Au, Pt or Cu. It is formed by those materials into desired size, shape and thickness at a desired position by a vapor deposition process.

What I claim is:

1. An ink jet head comprising:

ink discharge ports for discharging ink therethrough;

an ink path communicating with said discharge ports;

a plurality of separate plural-layer laminates each presenting separate heat acting surfaces, each of said plural-layer laminates comprising a plurality of heat resistive layers, and each of said heat resistive layers being a layer of one of said laminates and being disposed one atop another; and a plurality of electrodes separately connected to each of said heat resistive layers of each said plural-layer laminate so as to enable each of said heat resistive layers to be heated individually, wherein each of said heat resistive layer generates thermal energy to discharge ink through said discharge ports.

2. An ink jet head according to claim 1, wherein said discharge parts arranged just above said heat acting surface of said heat resistive layers.

3. An ink jet head according to claim 2, wherein said heat resistive layers are each laminated on a respective insulating layer.

4. An ink jet head according to claim 1, wherein said discharge ports are arranged so that a discharge direction of the liquid from said discharge ports is substantially the same as a liquid supply direction to said heat acting surfaces.

5. An ink jet head according to claim 1, further comprising a protective layer provided over said heat resistive layers.

6. A substrate for an ink jet head, comprising:

a support member;

a plurality of separate plural-layer laminates each presenting separate heat acting surfaces, each of said plural-layer laminates comprising a plurality of heat resistive layers provided on said support member, and each of said heat resistive layers being a layer of one of said laminates and being disposed one atop another; and a plurality of electrodes separately connected to each of said heat resistive layers of each said plural-layer laminate so as to enable each of said heat resistive layers to be heated individually, wherein each of said heat resistive layer generates thermal energy for discharging ink.

7. A substrate according to claim 6, wherein each of said heat resistive layers is laminated on a respective insulating layer.

8. A substrate according to claim 6, further comprising a protective layer provided over said heat resistive layers.

9. An ink jet head according to claim 1, wherein said discharge ports are arranged so that a discharge direction of the liquid from said discharge port is different from a liquid supply direction to said heat acting surfaces.

10. An ink jet head according to claim 1, wherein areas of heat generating portions of at least partial layers of said heat resistive layers are different from each other.

11. An ink jet head according to claim 1, wherein areas of heat generating portions of at least partial layers of said heat resistive layers are substantially the same.

12. An ink jet head according to claim 1, wherein resistance rates of at least partial layers of said heat resistive layers are different from each other.

13. An ink jet head according to claim 1, wherein resistance rates of at least partial layers of said heat resistive layers are substantially the same.

14. An ink jet head according to claim 1, wherein at least partial layers of said heat resistive layers are made of different materials.

15. An ink jet head according to claim 1, wherein at least partial layers of said heat resistive layers are made of the same material.

16. An ink jet head according to claim 1, wherein said plural-layer laminate comprises three heat resistive layers.

17. A substrate according to claim 6, wherein areas of heat generating portions of at least partial layers of said heat resistive layers are different from each other.

18. A substrate according to claim 6, wherein areas of heat generating portions of at least partial layers of said heat resistive layers are substantially the same.

19. A substrate according to claim 6, wherein resistance rates of heat generating portions of at least partial layers of said heat resistive layers are different from each other.

20. A substrate according to claim 6, wherein resistance rates of heat generating portions of at least partial layers of said heat resistive layers are substantially the same.

21. A substrate according to claim 6, wherein at least partial layers of said heat resistive layers are made of different materials.

22. A substrate according to claim 6, wherein at least partial layers of said heat resistive layers are made of the same material.

23. A substrate according to claim 6, wherein said plural-layer laminate comprises three heat resistive layers.

24. An ink jet apparatus comprising:

an ink jet head comprising an ink discharge port for discharging ink therethrough;

an ink path communicating with said discharge port;

a plurality of separate plural-layer laminates each presenting separate heat acting surfaces, each of said plural-layer laminates comprising a plurality of heat resistive layers, each of said heat resistive layers being a layer of one of said laminates and being disposed one atop another;

a plurality of electrodes separately connected to each of said heat resistive layers of each said plural-layer laminate so as to enable each of said heat resistive layers to be heated individually, wherein each of said heat resistive layer generates thermal energy to discharge ink through said discharge port; and supply means for supplying an ink discharge signal to said ink jet head.

* * * * *

UNITED STATES PATENT AND TRADEMARK OFFICE

CERTIFICATE OF CORRECTION

PATENT NO. : 4,965,594

DATED : October 23, 1990

INVENTOR(S) : HIROKAZU KOMURO

It is certified that error appears in the above-identified patent and that said Letters Patent is hereby corrected as shown below:

COLUMN 2

Line 31, "in" should be deleted.
Line 67, "communication" should read --communicating--.

COLUMN 3

Line 66, "heater 31" should read --heater 31A--.

COLUMN 4

Line 6, "second the" should read --the second--.
Line 56, "the" (second occurrence) should be deleted.
Line 67, "show" should read --shown--.
Line 68, the line should read
--therein an oblique view.--.

COLUMN 5

Line 18, "record" should read --recording--.
Line 45, "complex" should read --complexes--.

COLUMN 8

Line 1, "heat resistive layer" should read
--heat resistive layers--.
Line 5, "parts arranged" should read
--ports are arranged--.
Line 32, "heat resistive layer" should read
--heat resistive layers--.
Line 42, "discharge port" should read
--discharge ports--.

UNITED STATES PATENT AND TRADEMARK OFFICE

CERTIFICATE OF CORRECTION

PATENT NO. : 4,965,594

DATED : October 23, 1990

INVENTOR(S) : HIROKAZU KOMURO

It is certified that error appears in the above-identified patent and that said Letters Patent is hereby corrected as shown below:

COLUMN 10

Claim 24 should read as follows:

--24. An ink jet apparatus comprising:

an ink jet head comprising:

ink discharge ports for discharging ink therethrough, an ink path communicating with said discharge ports, a plurality of separate plural-layer laminates each presenting separate heat acting surfaces, each of said plural-layer laminates comprising a plurality of heat resistive layers, and each of said heat resistive layers being a layer of one of said laminates and being disposed one atop another, and a plurality of electrodes separately connected to each of said heat resistive layers of each said plural-layer laminate so as to enable each of said heat resistive layers to be heated individually, wherein each of said heat resistive layers generates thermal energy to discharge ink through said discharge ports; and supply means for supplying an ink discharge signal to said ink jet head.--.

Signed and Sealed this

Twenty-eighth Day of July, 1992

*Attest:*

DOUGLAS B. COMER

*Attesting Officer*

*Acting Commissioner of Patents and Trademarks*